United States Patent [19]

Montesi

[11] Patent Number: 4,630,604

[45] Date of Patent: Dec. 23, 1986

[54] VALVE ASSEMBLY FOR A REPLACEABLE FILTER RESPIRATOR

[75] Inventor: Edward N. Montesi, Barrington, R.I.

[73] Assignee: Siebe North, Inc., Charleston, S.C.

[21] Appl. No.: 721,284

[22] Filed: Apr. 9, 1985

[51] Int. Cl.[4] ..... A62B 7/00

[52] U.S. Cl. ..... 128/206.15; 128/206.17

[58] Field of Search ..... 128/206.15, 206.16, 128/206.17, 207.12

[56] References Cited

U.S. PATENT DOCUMENTS 3,029,812 4/1962 Matheson ..... 128/206.15

3,307,543 3/1967 Silverman ..... 128/206.17

3,621,841 11/1971 Austin et al. ..... 128/201.25

4,501,272 2/1985 Shigematsu et al. ..... 128/206.15

FOREIGN PATENT DOCUMENTS 85167 12/1935 Sweden ..... 128/207.12

249191 4/1970 U.S.S.R. ..... 128/206.15

*Primary Examiner*—Henry J. Recla

*Attorney, Agent, or Firm*—Abelman Frayne Rezac & Schwab

[57] ABSTRACT

A respirator having a disposable filter includes a valve body having a central aperture providing concentric inhalation and exhalation valves.

1 Claim, 5 Drawing Figures

VALVE ASSEMBLY FOR A REPLACEABLE FILTER RESPIRATOR

FIELD OF INVENTION

This invention relates to respirators of the type usually known as dust masks, such respirators including a filter of fiberous material for trapping and holding particulate matter in the form of dust or fume, or aerosols in the form of mist suspended in air that passes through the filter.

BACKGROUND OF THE INVENTION

In their simplest form, such respirators are comprised of a face piece formed from stabilized textile fibers, and which has been appropriately molded or otherwise formed for it to extend over the nose and mouth of a user, and, which is held in that position by elastic straps attached to the face piece and which are passed over the user's head to resiliently hold the respirator in situ over the user's nose and mouth.

Such dust masks are entirely temporary and fully disposable, in that once the filtering capability of the filter has been exhausted due to clogging of the filter, the user has no option other than to discard the dust mask and replace it with another, unused mask.

Refinements of such dust masks are disclosed in U.S. Pat. No. 4,319,567, Maggidson, U.S. Pat. No. 4,384,577, Huber, et al., and in U.S. Pat. No. 4,454,881, Huber, et al., each of which teaches stabilization and reinforcement of the filter in order to prevent collapse of the face piece under the partial vacuum produced by the user during inhalation, or, accidentally by the application of manual force of mishandling of the respirator.

While these constructions had an elegance absent from more mundane constructions, they still suffer from the same disadvantage that the entire respirator must be discarded after a relatively short period of use.

Further, in addition to impeding inhalation by the user as particulate matter builds up in the filter, such masks also progressively impede exhalation by the user through the clogged filter material, unless some form of exhalation valve is provided, as taught in U.S. Pat. No. 4,454,881, Huber et al. In the absence of an exhalation valve, a further physical stress is imposed on the user, particularly in the event that the user is involved in manually strenous work. Further, such respirators or dust masks have a relatively large internal volume that becomes filled with exhaled air as the user exhales, and which is then reinhaled when the user next inhales. Heat from the inhaled air raises temperature of the thick (extra thick in case of metal fume) filter fibers from exhalation. This heat is then transferred to the incoming air upon inhalation. A raise in temperature as low as 2°-3° causes great psychological and physical discomfort to the user.

An alternative approach to such respirators is disclosed in U.S. Pat. No. Des., 270,957, Maryyanek, which provides a face piece of soft rubber-like material, to which is attached a replaceable air filter in the form of a cartridge that snaps onto an inlet of the face piece controlled by a conventional inlet valve. The face piece is separately provided with dual conventional exhalation valves attached to the face piece at positions spaced from the inlet valve, and which are actuated by the rise in pressure in the face piece upon exhalation by the user.

In this construction, air inhaled through the filter does not have to be subsequently exhaled through the filter, but instead, is by-passed through the exhalation valves.

While this construction is successful in retaining disposability and replacement of the filter cartridge, it carries with it the disadvantage that the entire filter cartridge must be disposed of after use, with the attendant expense thereof, and also carries with it the disadvantage of the respirator being of considerable bulk and weight, and thus of perceptible inertia to movement of the user's head. Also, in this construction, the face piece and its associated exhalation valves present a relatively large internal volume within the face piece in which exhaled air is trapped, and, subsequently is re-inhaled by the user.

Replacement filter respirators of this latter type are referred to as semi-disposable respirators, in that the cartridge incorporating the filter material can be removed from the face piece for disposal and replacement by an unused cartridge, the face piece itself and its associated inhalation and exhalation valves being a permanently retained portion of the respirator.

SUMMARY OF THE INVENTION

It is an object of this invention to retain to the greatest possible extent the advantages of lightness, minimal inertia, and enhanced area of filtration surfaces such are found in known fully disposable respirators, while eliminating the disadvantages thereof, and, to retain the advantages of the known replaceable filter respirators in replaceability of the filter, while minimizing the weight penalty, kinetic inertia, and exhaled air retention disadvantages thereof to the greatest possible extent.

This is accomplished according to the present invention by providing a respirator that is totally devoid of separate exhalation valves and the accompanying weight and inertial penalties thereof, and by incorporating an exhalation valve directly into a valve body providing the inlet valve.

The replaceable filter element is supported by a frame, which is intentionally configured for it to be extremely light in weight, and for it to be kinetically balanced relative to the user's head, and which further is arranged to support a fully disposable filter of considerably greater filtering area than that of a conventional semi-disposable respirator.

In order to provide for the enhancement in effective area of filtering surface, and to provide for kinetic balancing of the filter frame, the frame is formed as an elongate member of dihedral planform that wraps around the face piece and extends to opposite sides of the user's face.

Preferably the exhalation valve is positioned centrally of the frame and concentric with the inhalation valve, the frame having ribs that support the filter material spaced from a back wall of the frame, and which provide channels for directing filtered air into the face piece through the inlet valve.

In this manner, by appropriate selection of the material employed for forming the face piece and the frame, the entire weight of the assembly can be kept to a fraction of that of a conventional replaceable filter respirator, and to a weight that only slightly exceeds the weight of a conventional fully disposable respirator.

By reducing the weight and inertia of the respirator to the greatest possible extent, sources of annoyance to the user are removed, making the respirator comfortable to wear over extended periods of time, even in the event that the user is highly physically active.

Further, as the requirement for separate conventional exhalation valves is eliminated in its entirety, the contained volume of the face piece can be reduced to a mere fraction of that of a conventional semi-disposable respirator, thus substantially reducing the entrapment of stale exhaled air within the face piece.

Further, by virtue of elimination of the conventional exhalation valves of the conventional replaceable filter respirator, the filter can be positioned in closer proximity to the user's face, thus considerably improving the field of view of the user, while at the same time further minimizing inertial effects on the user's face caused by the respirator.

A primary use of the respirator of the present invention is in conjunction with a welders shield, the respirator being of sufficiently minor dimensions for it to be positioned within the welders shield without in any way affecting or interfering with raising and lowering of the shield.

DESCRIPTION OF THE DRAWINGS

The invention will now be described with reference to the accompanying drawings, which illustrate a preferred embodiment of the respirator of the present invention, and, in which.

DESCRIPTION OF THE PREFERRED EMBODIMENTS

Figure 1:
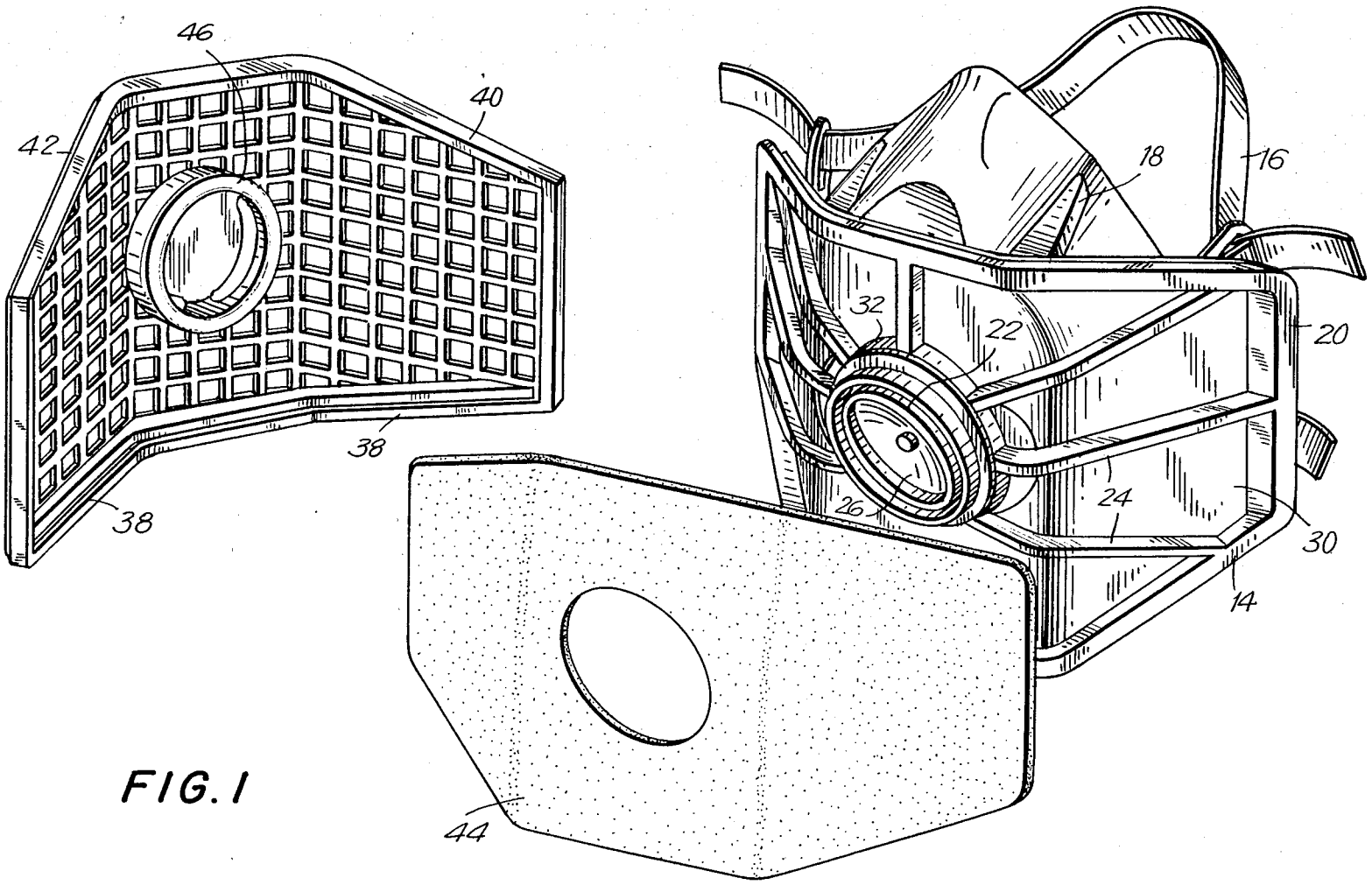
FIG. 1 is a front perspective view of the removable filter respirator according to the present invention.
Figure 3:
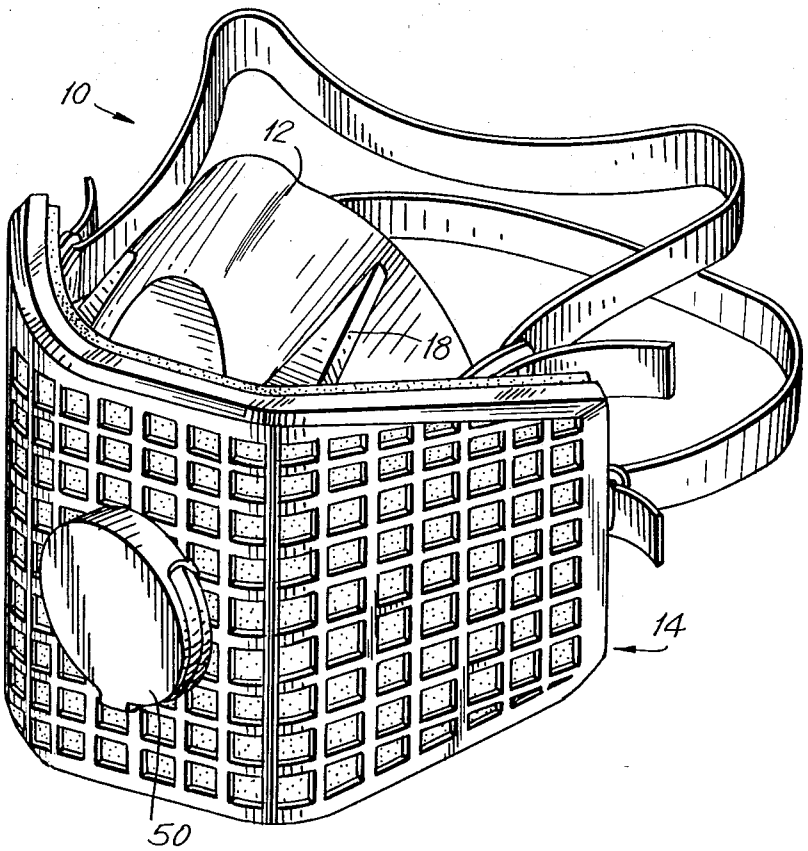
FIG. 3 is a rear perspective view of the respirator of FIG. 1.
Figure 2:
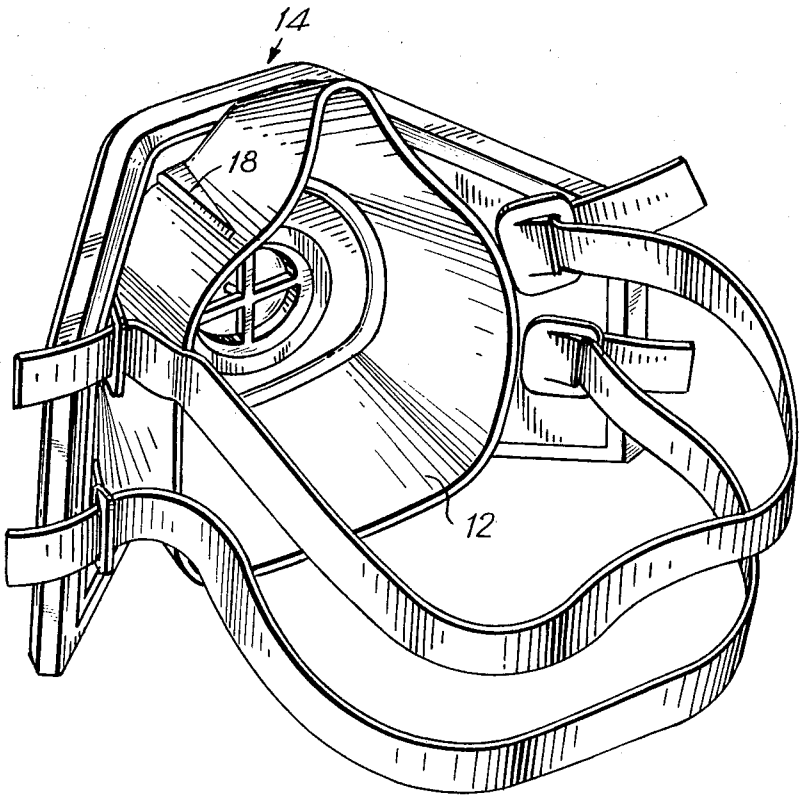
FIG. 2 is an exploded perspective view of the respirator of FIG. 1.

Referring FIGS. 1 to 4 of the accompanying drawings, the replaceable filter respirator is indicated generally at 10, the respirator being comprised of a face piece 12, to which is attached a frame 14, the frame providing attachments for straps 16 employed to secure the respirator on the head of a user with the face piece surrounding the nose and mouth of the user and providing an effective continuous seal with the user's face, despite variations in the contours and configurations of the particular user's face.

The face piece 12, such as is well known in the art, is molded or otherwise formed from an extremely soft and pliable rubber-like material, that can be worn on the user's face for extended periods of time without causing discomfort to the user. Optionally, the face piece 12 may be formed from a foamed, closed-cell plastics material, further to minimize the already minimal weight of the face piece.

The frame, indicated generally at 14, is attached to a forward portion of the face piece 12, the face piece conveniently including buttresses 18 to stabilize the frame 14, and equalize the compressive stresses exerted on the face piece by the frame 14 at the time the frame 14 is drawn towards the user's head by the straps 16. The buttresses 18 are of particular utility in preventing inward collapse of the face piece 12 at any particular location when under compressive loading and, a concomitant discontinuity in the seal between the face of the user and the face piece due to such unequal stressing.

The frame 14 may be formed in any convenient manner and of any convenient material, including light-weight metal, but is preferably formed by injection molding a light-weight relatively rigid, and relatively impact resistant plastics material, such as an acrylic resin.

While the frame 14 preferably is formed as a unitary injection molding, it can be formed with equal facility of separate members assembled to each other.

The frame 14 is comprised by an outer perimetral flange 20 of a generally trapezoidal form, the flange 20 being symmetrical about a central ring 22, that is rigidly interconnected with the flange 20 by ribs 24 providing air flow channels between adjacent pairs of ribs.

The ring 22 provides a support, or itself comprises a support for an exhalation valve 26 supported on a spider 28, and an inhalation valve 34, as is later described. Optionally, the exhalation valve 26 and its supporting spider 28 can be formed as a separate sub-assembly that is a press fit within the central ring 22.

The rear face of the frame 14 is completely closed off by a back wall 30, either formed integrally with the frame 14, or, secured to the frame 14 after the formation thereof.

The back wall 30 provides a central opening 32 concentric with the support ring 22, such that air flowing in the channels provided by the outer perimetrial flange 20, the ribs 24, and the back wall will flow towards and through the central opening 32.

The back wall 30 provides a relatively rigid connection for the face piece 12 in surrounding relationship with the central opening 32, the central ring 22 providing a support for an annular inhalation valve 34.

The outer perimetrial flange 20 of the frame 14 is provided with a rebate for the reception of locking tongues or ribs 38 formed on a perimetrial flange 40 of perforate a filter retainer member 42, adapted to embrace and hold a replaceable filter member 44 in abutting relationship with the outer perimetrial flange 20, the ribs 24, and the central ring 22 of the frame 14.

The filter retainer member 42 is sufficiently perforate to provide minimal impedence to air flow through the filter member 44, and includes a central annular 46 adapted to engage the perimeter of a circular opening 48 in the filter member 44 and hold it clamped against the central ring 22.

Conveniently, the filter retainer member 42 is provided with a deflector guard 50 overlying the central annulus 46 for deflecting exhaled air downwardly away from the eyes of the user, and away from the back side of the welders shield, if used, to prevent fogging of the lens.

Preferably, the locking tongues 38 are asymetrically positioned relative to the frame 12 and the filter retainer member 42, such that the frame 12 will only accept the filter retainer member in the correct orientation in which the deflector guard 50 has its outlet facing downwardly.

As will be seen in the drawings, the frame 14 is formed as a dihedral and considerably elongate in horizontal dimensions in order that the side portions of the frame 14, can extend towards the user's face, and to opposite sides of the face piece 12.

The assembly is completed by the straps 16, which are attached to the frame 14 by buckles 52, either integrally formed with the frame 14 or subsequently attached thereto in any convenient matter.

Figure 4:
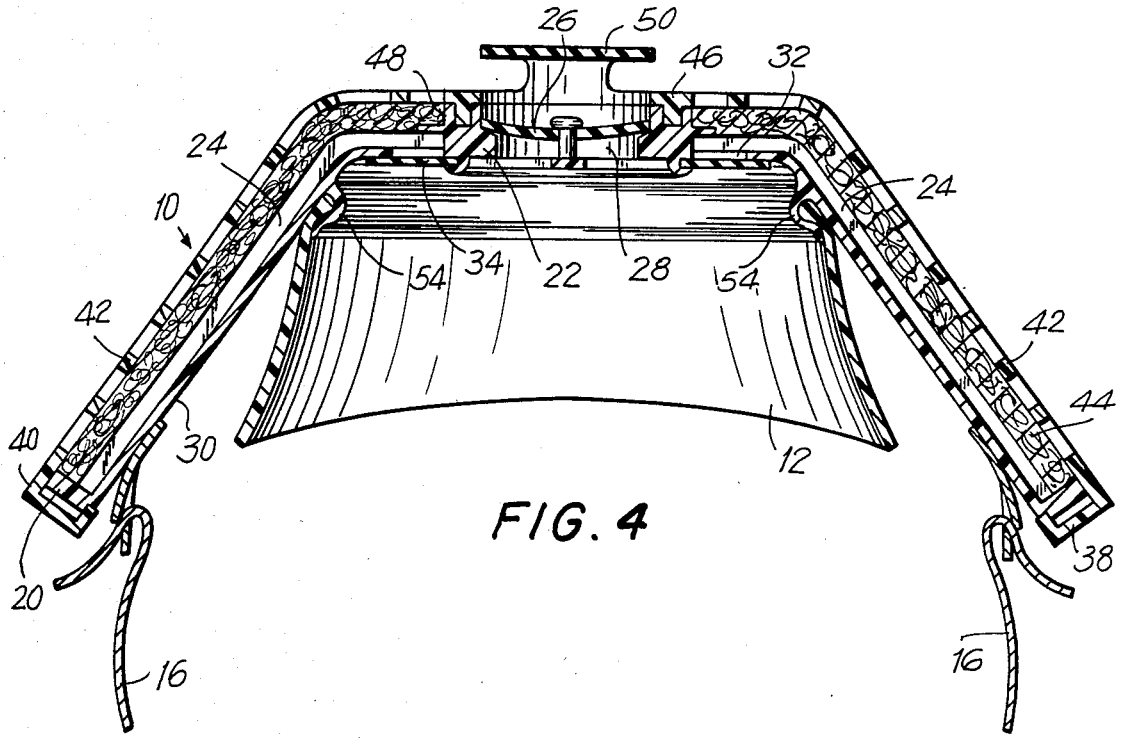
FIG. 4 is a cross-section through the respirator taken in a horizontal plane.

Referring more particularly now to FIG. 4, the face piece 12 is attached to the frame 14 by it being trapped within a groove 54 provided by the back wall 30.

The groove 54 is of relatively large peripheral extent, such that a considerable reduction in the weight of the face piece ensues, again resulting in minimal weight of the respirator.

Secured within the central ring 22, and positioned on the outer side of the spider 28, is the exhalation valve 26 which is of an extremely flexible but dimensionally stable sheet material and, which seats at its edges on a valve seat provided by the central ring 22 in the event that air is inhaled through the central ring 22, and, which will freely flex away from the spider 28 and the central ring 22 in the event that air is exhaled through the central ring 22, thus providing an exhalation valve integral with and positioned interiorly of the central ring 22.

Exteriorly of the central ring 22, and secured thereto in any convenient manner, such as by ultra-sonic upsetting of the material of the central ring 22, is the inhalation valve 34, which also is of said extremely flexible and dimensionally stable sheet material and which extends radially from the outer circumference of the central ring 22 and into seating relationship with a valve seat provided by the back wall 30 of the frame 14.

The two valves 26 and 36 complete the assemblage, the manner of operation of the assemblage now being discussed.

With a filter member 44 correctly positioned on the frame 14, and held in that position by snapping the filter retaining member 40 over the peripheral edges of the frame 14, the only route for air inhaled through the filter 44 is through the channels provided between the ribs 24, and which lead to the central opening 32. Upon inhalation by the user, and a drop in pressure within the face piece, the flap valve 58 lifts at its edges, permitting ready access of the filtered air to the interior of the face piece 12 with minimal impedence, the impedence to such air flow being greatly minimized by the extremely large effective area of the filter 44, and the negligible impedence to air flow through the central opening 22 and the inhalation valve 58.

Upon exhalation by the user and a rise in pressure within the face piece 12, the inhalation valve 58 immediately closes, and, the exhalation valve 56 immediately opens, permitting the exhaust of exhaled air directly to atmosphere from the interior of the face piece 12 and with an absolute minimum of impedence.

Thus, exhaled air can not proceed into the channels between the ribs 24 and into the filter, the channels remaining charged with pure and unadulterated air during exhalation by the user.

Further, by virtue of minimization of the contained volume of the face piece 12, only a minor amount of exhaled air remains trapped within the face piece 12 after exhalation by the user. Further, and by virtue of the extremely large effective area of the filter 44, impedence to air inspired through the filter 44 is minimized, even when in a partially used and partially clogged condition, thus prolonging the intervals between replacement of the filter material.

The filter material itself can be replaced with great facility, merely by snapping off the filter retainer member 42, removal of the used filter member 44 and discarding it, repositioning a replacement filter member 44 over the central clamping ring 22, and by then snapping on the filter retainer member 42, to hold the filter member appropriately clamped onto the frame 14, the ribs 24, and the central clamping ring 22, thus inhibiting leakage of contaminated air at the peripheral edges of the filter member 44.

During use of a conventional respirator, the user will, by a virtue of movement of the user's head and which may be a relatively rapid movement, exert significant kinetic forces on the respirator. This can cause either discomfort to the user, or, lifting of the edges of the face piece 12 out of sealing engagement with the user's face, thus permitting inhalation by the user of contaminated air.

Such a possibility is avoided to the greatest possible extent according to the present invention by forming the frame 14 as a dihedral, such that all portions of the frame 14 are in as close proximity to the user's face as can be arranged. Further, by connecting the straps 16 directly to the dihedrally shaped frame 14, further resistence to movement of the frame 14 is provided, in that the straps also will resist any attempted lateral movement of the ends of the frame 14, or, any attempted rotational movement of the frame 14 about the general central axis of the respirator.

It will be appreciated that the construction of respirator described above is illustrative of a preferred embodiment of the invention and, that various modifications of that structure may be made without departing from the scope of the appended claims. For example, the ribs 24 may be increased in number, and, may be arranged other than radial to the central clamping ring 22, provided, or course, that the ribs 24 retain the unrestricted channels for airflow between the ribs and into the central aperture 32. Also, while the filter retaining member has been shown as having a generally rectangular graticule permitting air flow to the filter member 44, any other convenient configuration of perforate grid can be provided. Also, any other convenient means for attaching the filter retainer member to the frame 14 can be provided, or, for attaching the frame 14 to the face piece 12.

Central to the inventive concept of this invention is the provision of concentric inhalation and exhalation valves, which in addition to providing minimal impedence to air flow into and out of the face piece, also provide a substantial weight reduction in the total weight of the respirator, as compared to the weight of a respirator having independent exhalation valves, such as are common in the art.

A further advantage accruing from the use of such concentric inhalation and exhalation valves is that any moisture deposited within the face piece by virtue of condensation from the exhaled air of the user will occur dominantly at the exhalation valve 56, at a position in which it readily can be evacuated from the mask by way of the deflector guard 50.

Conveniently, the concentric inhalation and exhalation valves are die cut in a single operation with the external diameter of the inner annulus identical to the inner diameter of the outer annulus. Thus permitting economy in the manufacture of the valves simultaneously in a single strike of the cutting die, and with substantially zero wastage of materials.

Figure 5:
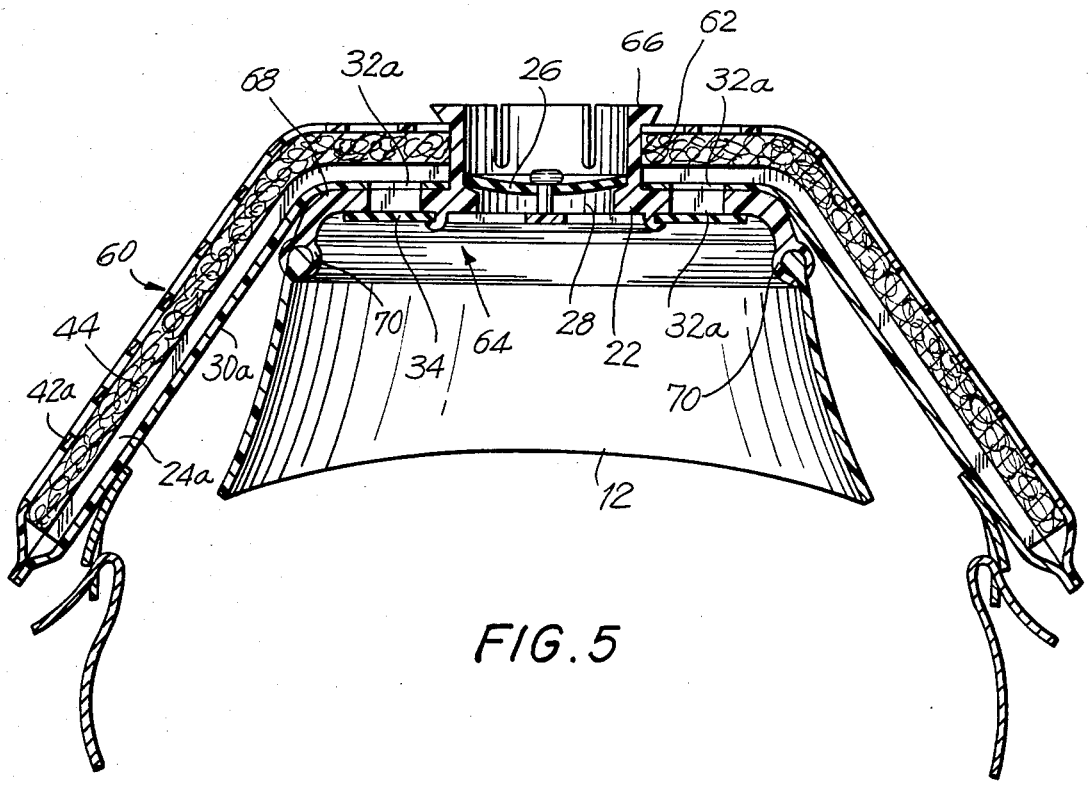
FIG. 5 illustrates in cross-section an alternative embodiment of the respirator incorporating a fully disposable filter sub-assembly.

Referring now to FIG. 5, there is illustrated a modification of the respirator of the present invention, in which the filter 60 is formed as a complete unitary sub-assembly, that is to be snapped onto a snout 62 of a slightly modified form of valve structure.

In FIG. 5, the filter assembly is formed entirely separate from the face piece 12, and is adapted to be snapped onto a snout 62 of the face piece, and subsequently removed therefrom for replacement.

To provide for attachment of the filter sub-assembly, the central ring 22 is extended forwardly of the face piece 12, and, at its forward extremity is provided with spring latches 66, such latches being readily formable during the molding of the central ring and its associated structures.

As in the previous embodiment, the central ring is provided internally with a spider 28 on which the extremely flexible but dimensionally stable flap valve 26 is located.

Externally, the central ring 22 is provided with a further spider 32*a*, which supports and positions the central ring 22 within an opening of a mounting plate 68, the mounting plate 68 providing the required attachment 70 to the face piece 12.

The filter assembly indicated generally at 60, in this instance is a completely pre-assembled filter unit, that not only incorporates the filter material 44, but which also can incorporate materials for treating air passing through the filter, such as activated carbon, diatomacious earth, or the like, or which can contain textile fibers that have been provided with an electrostatic charge.

The filter 44 is encased within an extremely thin-walled shell of thermo-formable plastics sheeting, the rear face 30 of which has been vacuum formed to provide ribs 24*a* providing air channels as in the previous embodiment, and which extend up to a central opening 32*a* in the back wall 30*a*.

The front wall 42*a* is formed as a perforate surface permitting the passage of air into and through the filter, the front and rear walls being fused to each other in any convenient manner, to provide an enclosing envelope for the contained filter material, and is provided with lugs 16 for the attachment of straps.

In order to replace a used filter assembly with an unused one, it is merely necessary for the user to depress the spring latches 66, in order to remove the filter sub-assembly 60 from the face piece 12 and valve assembly 64, and then to slip a replacement filter sub-assembly over the snout 62 of the face piece.

Various other modifications are contemplated within the scope of the appended claims, the embodiments discussed above being illustrated only of preferred embodiments falling within the scope of the appended claims.

What is claimed is:

1. In a half mask of the type including:

a face piece, a valve assembly rigidly affixed to said face piece and providing an exhalation valve having an inlet and an outlet defining a cylindrical valve seat for an exhalation valve, and, an inhalation valve having an inlet and an outlet defining an annular valve seat for an inhalation valve arranged concentrically with and radially outwardly of said exhalation valve;

valve members cooperating with said respective valve seats; and, filter element means in communication with said annular valve seat: the improvement comprising:

said face piece being formed from a resilient and compliant material;

a substantially rigid imperforate wall member integral with and completely surrounding said annular valve seat and extending radially outwardly thereof;

said imperforate wall member terminating at its outer periphery in a continuous peripheral flange extending forwardly of said wall member and then outwardly thereof to define a shallow recess at the front of said wall member;

ribs on said wall member extending forwardly thereof and in directions generally radially of said valve assembly, said ribs defining channels on the front face of said wall member which communicate with said inlet of said annular inhalation valve seat;

a layer of filter material co-extensive with said imperforate wall member and overlying said ribs;

a perforate frame member co-extensive with said wall member and overlying said filter material, said frame member having a central opening and a cylindrical extension surrounding said opening for spigotal cooperation with said cylindrical valve seat of said exhalation valve;

latch means integral with said frame member and for latching cooperation with the outwardly extending portion of said wall flange; and, harness attachment means on a rearmost face of said wall for attaching said half mask to the head of a user;

said wall, said filter element and said frame extending laterally toward both sides of said face piece in dihedral formation and presenting a maximized filtering surface area of said filter.

* * * * *